US005305968A

United States Patent [19]

Arlton

[11] Patent Number: 5,305,968

[45] Date of Patent: Apr. 26, 1994

[54] DEVICE FOR AUTOMATICALLY STABILIZING THE YAW MOTION OF A HELICOPTER

[76] Inventor: Paul E. Arlton, 1132 Anthrop Dr., West Lafayette, Ind. 47906

[21] Appl. No.: 770,013

[22] Filed: Sep. 30, 1991

[51] Int. Cl.[5] ..... B64C 27/82

[52] U.S. Cl. ..... 244/17.13; 244/17.19; 244/79; 416/52; 416/147

[58] Field of Search ..... 244/17.11, 17.13, 17.19, 244/17.21, 17.25; 416/52, 147

[56] References Cited

U.S. PATENT DOCUMENTS

| | | | |
|---|---|---|---|
| 2,384,516 | 9/1945 | Young | 244/17.13 |
| 2,689,099 | 9/1954 | Lightfoot | 244/17.19 |
| 3,004,736 | 10/1961 | Culver et al. . | |
| 3,027,948 | 4/1962 | Goland et al. | 244/17.19 |
| 3,211,235 | 10/1965 | Bretl . | |
| 3,528,633 | 9/1970 | Knemeyer . | |
| 3,532,302 | 10/1970 | Dean . | |
| 4,272,041 | 6/1981 | Mabuchi et al. . | |
| 4,759,514 | 7/1988 | Burkam . | |

OTHER PUBLICATIONS

Rock, G. "SSP-5", *American Aircraft Modeler* Mar. 1973, pp. 41–45 and 76–79.

*Primary Examiner*—Galen Barefoot

*Attorney, Agent, or Firm*—Barnes & Thornburg

[57] ABSTRACT

In a helicopter having a tail rotor with a plurality of rotor blades extending radially from a hollow rotor shaft which is mounted for rotation about a transverse rotor axis, and having a push-pull rod extending through the hollow shaft and operably connected to the blades to manually vary the collective pitch of the blades, a device for automatically stabilizing the yaw motion of the helicopter includes a gyroscopic assembly having a gyro rotor mounted to rotate with the tail rotor, to pivot about a substantially longitudinal pivot axis by and at the outboard end of the push-pull rod and to automatically vary the collective pitch of the blades in response to yaw motion.

46 Claims, 3 Drawing Sheets

DEVICE FOR AUTOMATICALLY STABILIZING THE YAW MOTION OF A HELICOPTER

FIELD OF THE INVENTION

This invention relates to the field of yaw control systems for both model and full size helicopters, and in particular to a device pivotally supported at the outboard end of the helicopter's tail rotor control elements for automatically varying the tail rotor thrust to produce a stabilizing yaw moment.

BACKGROUND OF THE INVENTION

In general, maintaining the stable yaw orientation of a helicopter in hover or low speed flight can be a difficult business for the pilot. To counterbalance the constantly changing torques on the helicopter fuselage produced by the main rotor blades and atmospheric conditions such as lateral wind gusts, helicopter pilots must continually manipulate the yaw controls of their aircraft.

Conventionally, the pilot of a full size helicopter controls the tail rotors by manipulating foot pedals located within the cockpit. Cables, push-pull rods, and bellcranks connect the pedals to the collective pitch controls of the tail rotor blades. As the pilot adjusts the pedal position, the change in angle of attack (pitch) and associated thrust force of the rotating tail rotor blades results in a yaw moment about the center of gravity of the helicopter. This moment is directed to maneuver the helicopter, or to oppose any destabilizing yaw moment sensed by the pilot.

Tail rotors of radio-controlled model helicopters operate in a manner identical to full size helicopters. The pilot manipulates a hand-held radio transmitter which in turn sends commands to electro-mechanical servo actuators located within the flying model. Push-pull rods and bellcranks connect the servos to the collective pitch controls of the tail rotor blades. Yaw instability can make a model helicopter particularly difficult for the pilot to control. This is because the pilot manipulates controls affixed to the radio transmitter, not to the model, so flight controls for yaw, roll and fore-aft cyclic are effectively reversed when the nose of the model becomes oriented toward the pilot.

To control yaw instability, both full-size and model helicopters are frequently equipped with stabilizer systems. Gyro-stabilizer systems can be broadly classified as either mechanical or electro-mechanical. Mechanical systems generally rely on precessional (angular) displacement of a relatively large gyroscopic arm or flywheel mechanism to alter the pitch of the tail rotor blades in opposition to any yaw displacement of the helicopter. Electro-mechanical systems sense the precessional displacement of a relatively small flywheel mechanism, and control the tail rotor blades through electronic amplification and electro-mechanical and/or hydraulic servo actuators. Modern model helicopters frequently carry electro-mechanical gyro stabilizer systems which are electronically mixed into the tail rotor servo control circuit. These gyro systems are relatively expensive and heavy, and draw power from the airborne radio receiver system batteries. An example of an electro-mechanical system designed for full-size helicopters is described in U.S. Pat. No. 3,528,633.

Some yaw stabilizer systems, especially more sophisticated electro-mechanical systems, disengage whenever the pilot maneuvers the aircraft. Other systems, most notably mechanical systems, act to suppress all yaw motion of the helicopter including that desired by the pilot. With these mechanical systems the pilot must forcibly override the gyroscopic mechanism in order to control the tail rotor for trimming and normal flight. Since gyroscopic mechanisms tend to resist displacement, the pilot will feel resistance to control inputs. This resistance will typically persist as long as the rate of yaw is not zero. Generally, these systems tend to increase stability at the expense of controllability.

One such mechanical device is shown in U.S. Pat. No. 3,004,736. The mechanism includes a gyroscopic mass in the form of weighted arms extending radially from and fixed via a gimbal to a rotating splined shaft which in turn is connected to the tail rotor pitch control mechanism. Precession (tilt) of the rotating arms about an axis perpendicular to and offset from the axis of rotation displaces the splined shaft axially thereby altering the pitch of the tail rotor blades. Override springs are provided on the tail rotor control cables to accommodate axial movement of the splined shaft. Pilot control inputs must forcibly change or override the gyroscopic mechanism in order to maneuver the aircraft. A related mechanical gyro stabilizer mechanism is detailed on page 41 of the March 1973 issue of American Aircraft Modeler magazine (originally located at 733 15th Street N.W., Washington, D.C. 20005). In this mechanism yaw moment applied to a gyroscopic ring causes the ring to precess (tilt) off from the vertical about an offset axis. Displacement of the ring moves a slider on the tail rotor shaft and changes the pitch of the tail rotor blades to counter the yaw moment. This mechanism also suppresses pilot inputs, and requires override springs, ball bearings, pivot linkages, a gimbal mechanism and specially designed tail boom structure.

Another mechanical gyro stabilizer system is described in U.S. Pat. No. 4,759,514. This mechanism relies on gyroscopic precession of the entire tail rotor assembly about an offset axis to displace a slider connected to the tail rotor blades. This system differs from the aforementioned mechanical systems in that stabilizer control inputs are mechanically mixed with, rather than overridden by, pilot control inputs. Obvious drawbacks to this system include the complexity of the tail rotor mounting structure, and the required universal joint incorporated into the tail rotor drive shaft.

Other references to helicopter tail rotor control and stabilizer systems include U.S. Pat. No. 3,211,235 which describes a basic tail rotor control system; U.S. Pat. No. 3,532,302 which describes the use on a military helicopter of a spring loaded actuator to control tail rotor pitch adequately for a return flight to base if the primary control linkage system fails; and U.S. Pat. No. 4,272,041 which describes a non-gyroscopic technique for reducing transient yaw instability in model helicopters using a complex system of gears, levers and push-pull rods to sense and correct for torque changes.

These and similar yaw stabilizer systems currently available suffer from one or more disadvantages. Mechanical designs rely on expensive multiple ball bearings, complicated gimbal mechanisms, specially designed sliding shafting, and specially designed tail boom structure and pivoting mechanisms. Many require some sort of override springs on the pilot yaw control cables which must be carefully adjusted or "tuned". Stiff springs dampen gyro effectiveness while overly elastic springs dangerously decrease pilot control. Electro-mechanical systems are heavy and expensive in model applications, and require servo actuators which are complex and expensive in full-size applications.

What is needed is a stabilizer system which is simple, lightweight and inexpensive, which requires little power to operate, and which would not unduly inhibit pilot control for normal maneuvering.

SUMMARY OF THE INVENTION

Generally speaking there is provided herein a device for automatically stabilizing the yaw motion of a helicopter. Such device is generally supported by the pitch varying control elements of the tail rotor and operates as an offset to the pilot's tail rotor controls.

In a helicopter having a tail rotor with a plurality of rotor blades extending radially from a hollow rotor shaft which is mounted for rotation about a transverse rotor axis, and having a push-pull rod extending through the hollow shaft and operably connected to the blades to manually vary the collective pitch of the blades, a device for automatically stabilizing the yaw motion of the helicopter includes a gyroscopic assembly having a gyro rotor mounted to rotate with the tail rotor, pivot about a substantially longitudinal pivot axis by and at the outboard end of the push-pull rod, and to automatically vary the collective pitch of the blades in response to yaw motion. The gyroscopic assembly includes a pitch slider operably connected with the push-pull rod, tail rotor and gyro rotor to move generally as a unit with the push-pull rod in order to vary the collective pitch of the rotor blades upon manual movement of the push-pull rod relative to the rotor shaft, and to be automatically slid relative to the push-pull rod in order to vary the collective pitch of the rotor blades upon precession of the gyro rotor.

An object of the present invention is to provide an improved device for automatically stabilizing the yaw motion of a helicopter.

Another objective of the present invention is to provide an automatic tail rotor yaw control system based upon precession of a gyroscopic mechanism from a destabilizing yaw moment applied to the aircraft.

Further objectives and advantages will become apparent from the following description of the preferred embodiment.

DESCRIPTION OF THE PREFERRED EMBODIMENT

Figure 1:
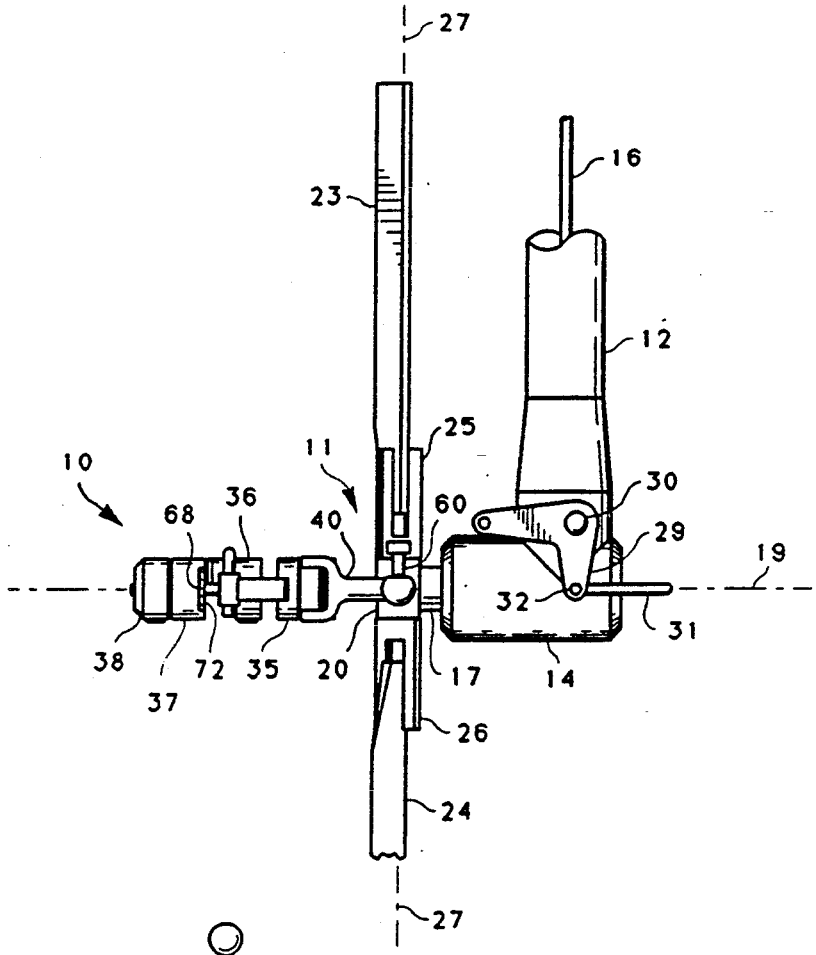
FIG. 1 is a plan view of the device for automatically stabilizing the yaw motion of a helicopter in accordance with the preferred embodiment of the present invention, and with drive bar 65, coil springs 74 and 75 and a portion of gyro arms 67 and 68 omitted for clarity.

For the purposes of promoting an understanding of the principles of the invention, reference will now be made to the embodiment illustrated in the drawings and specific language will be used to describe the same. It will nevertheless be understood that no limitation of the scope of the invention is thereby intended. Such alterations and further modifications in the illustrated device, and such further applications of the principles of the invention as illustrated therein, are contemplated as would normally occur to one skilled in the art to which the invention relates.

Figure 2:
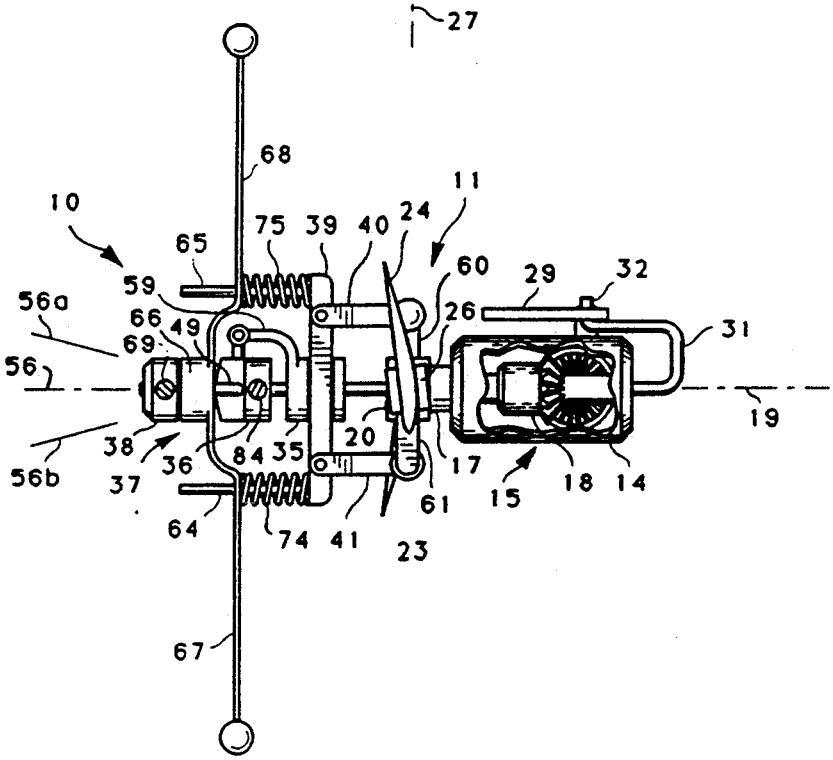
FIG. 2 is a rear elevation view of the device of FIG. 1 with a portion of the gear box broken away for clarity.

Referring to FIGS. 1 and 2, there is shown a yaw stabilizing assembly 10 operably connected with a tail rotor 11 at the rearward end of tail boom 12 of a helicopter in accordance with the preferred embodiment of the present invention. Tail boom 12 extends rearward from the cabin section of the helicopter and supports tail rotor gearbox 14. Gearbox 14 houses gear assembly 15 which transmits the rotary drive from drive shaft 16 of tail boom 12 to a rotor shaft 17. Rotor shaft 17 extends transversely through gearbox 14 and is rigidly connected for rotation with output drive gear 18 about transverse rotor axis 19. Rotor shaft 17 is hollow and terminates at its outboard end in a rotor hub 20. A pair of blade grips 25 and 26 extend radially from hub 20 and hold a corresponding pair of mutually opposed blades 23 and 24. Blade grips 25 and 26 are mounted to hub 20 to pivot about a pitch axis 27 which is orthogonal to and intersects rotor axis 19, and which rotates with blades 23 and 24. Mutual pivoting of blade grips 25 and 26 and their rotor blades 23 and 24 about pitch axis 27 as described herein changes the collective pitch of rotor blades 23 and 24, thereby changing the corresponding thrust produced by the rotating rotor blades, which in turn produces a yaw moment about the main rotor axis of the helicopter.

Yaw commands from the pilot are transmitted through a bellcrank 29 which is pivotally mounted at 30 to tail boom 12. A push-pull rod 31 is connected at one end 32 to bellcrank 29 and extends in a U-shape around gearbox 14, through hollow rotor shaft 17 and hollow hub 20, and outward from rotor blades 23 and 24.

Figure 3:
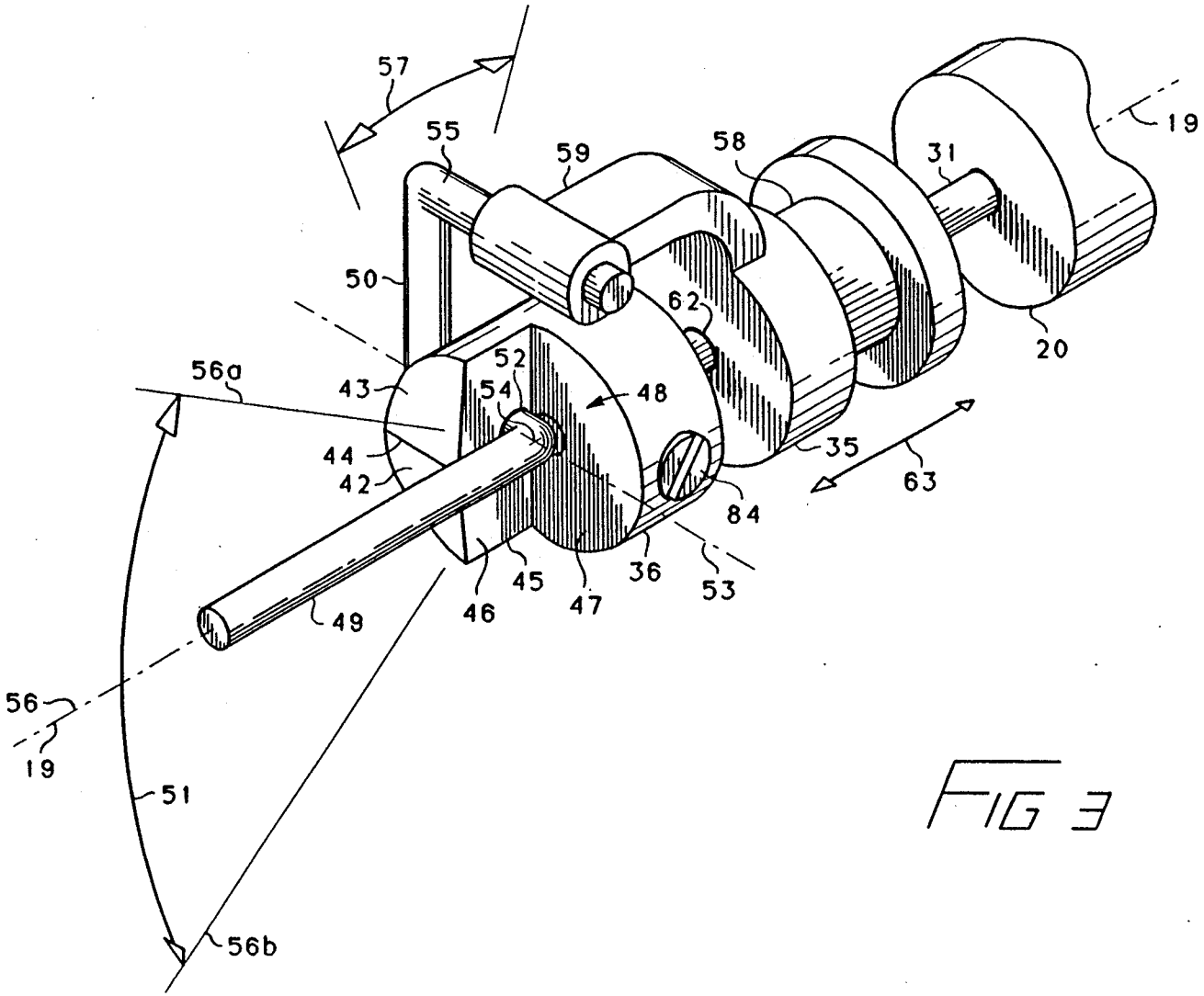
FIG. 3 is a perspective view of the rotor hub 20, push-pull rod 31, pitch slider 35, gyro mount 36, and gyro pivot arm 50 of the device of FIG. 2.

Referring to FIGS. 1, 2 and 3, the remaining components of yaw stabilizing assembly 10 and tail rotor 11 include pitch slider 35, gyro mount 36, gyro rotor 37, gyro retaining collar 38, crosslink 39 and pitch links 40 and 41. Gyro mount 36 is mounted to the outboard end of push-pull rod 31 and is rigidly fixed thereto by set screw 84. Gyro mount 36 is generally cylindrical with a pivot arm extension 45 extending outward therefrom. The outboard end of pivot arm extension 45 defines a pair of pivot limit faces 42 and 43 which meet at gyro pivot ridge 44. Faces 42 and 43 are angled inward from pivot ridge 44, each forming an angle of approximately 15° with a plane perpendicular to rotor axis 19 (i.e., planar surface 47 of gyro mount 36). Gyro mount 36 is fixed to push-pull rod 31 so that pivot ridge 44 is generally perpendicular to the helicopter's main rotor axis. Extension 45 also defines a rearward facing planar surface 46 which, together with the outward facing planar surface 47, defines a pivot arm recess 48 within which is received axle portion 49 of gyro pivot arm 50. Extension 45 has a longitudinal bore 52 which defines a longitudinal gyro pivot axis 53 which orthogonally intersects (at 54) transverse rotor axis 19. Gyro pivot arm 50 extends through bore 52 and bends at axis intersection 54, within pivot arm recess 48, and extends outward therefrom to form outwardly extending axle portion 49. Gyro rotor 37 is mounted for rotation on axle portion 49 and about a gyro axis 56 defined thereby. Gyro axis 56 sweeps through an angle indicated at arrow 51 and between upper and lower limits 56*a* and 56*b*, which limits are mechanically defined by pivot limit faces 42 and 43, as described herein. Upon exiting at the forward end of bore 52, pivot arm 50 extends generally upward and then rearward to form a slider coupling arm 55. As shown in FIG. 3, with pivot arm 50 in a neutral position, gyro axis 56 and transverse rotor axis 19 are colinear. As pivot arm 50 pivots about pivot axis 53, axle portion 49 and its gyro axis 56 sweep between 56*a* and 56*b*, causing coupling arm 55 to sweep laterally as indicated by arrow 57.

Pitch slider 35 is generally cylindrical and has a central passageway 62 through which extends push-pull rod 31, thus permitting slider 35 to slide along rod 31 and axis 19 between gyro mount 36 and hub 20. Pitch slider 35 further includes a semi-flexible slider link 59 which extends generally upward and then outward to pivotally connect with slider coupling arm 55 of pivot arm 50. Slider link portion 59 of slider 35 is made of a material such as nylon which is rigid enough to cause slider 35 to move generally as a unit with push-pull rod 31 when the latter is translated along axis 19, but is also flexible enough to bend slightly vertically when coupling arm 55 pivots through the arc indicated at 57. In a full scale application, semi-flexible link 59 would preferably be replaced with a single link, pivotally connected at one end to arm 55 and at its other end to slider 35. Slider 35 also defines a central, reduced diameter section 58 which engages with crosslink 39. Crosslink 39 is generally a bar with a central opening (not shown) sized to surround and engage with reduced diameter section 58 so as to rotate freely about slider 35 and axis 19, but slide laterally as a unit with slider 35 along axis 19 as indicated by arrow 63. Crosslink 39 also includes a pair of outwardly extending drive bars 64 and 65. A pair of diametrically opposed pitch links 40 and 41 are pivotally connected at their outboard yoke ends to crosslink 39 and at their inboard ends to corresponding blade grip arms 60 and 61, respectively, which in turn are rigidly connected to blade grips 25 and 26, respectively. By this connection, lateral movement of crosslink 39 and attached pitch links 40 and 41 rotates grip arms 60 and 61 and their corresponding blade grips 25 and 26 about rotor pitch axis 27, thereby varying the collective pitch of rotor blades 23 and 24.

Gyro rotor 37 includes a gyro hub 66 and a pair of diametrically extending weighted gyro arms 67 and 68. Gyro rotor 37 is held for rotation about gyro axis 56 on axle portion 49 by gyro retaining collar 38 which is fixedly secured to the end of axle portion 49 by set screw 69. In this configuration, gyro rotor 37 and its generally planar inboard side 72 rotate in engaging abutment against the outboard end of gyro mount 36, and specifically against gyro pivot ridge 44.

Weighted gyro arms 67 and 68 have a generally flat, rectangular cross-section (as shown in FIG. 1) and extend generally radially from hub 66. Each of arms 67 and 68 have a hole (not shown) through which extends one of the corresponding drive bars 64 and 65, thereby coupling gyro rotor 37 to rotate as a unit with crosslink 39 and tail rotor 11. The hole in each of arms 67 and 68 is sized to permit the arm to form an angle with its corresponding drive bar 64 and 65 as the arms 67 and 68 pivot with pivot arm 50. A pair of coil springs 74 and 75 encircle corresponding drive bar 64 and 65 between crosslink 39 and corresponding gyro arms 67 and 68, respectively. Springs 74 and 75 dampen unwanted vibrations and bias gyro rotor 37 to a zero or neutral position where axle portion 49 and its gyro axis 56 align with transverse rotor axis 19, as shown in FIGS. 2 and 3.

In operation, yaw stabilizing assembly 10 operates with the tail rotor as follows:

Slider 35, gyro mount 36, gyro pivot arm 50, and gyro retaining collar 38 are all connected to move laterally as a unit with push-pull rod 31 along axis 19 relative to gearbox 14. These elements do not rotate about axis 19 relative to gearbox 14. Hollow rotor shaft 17 with its rotor blades 23 and 24, pitch links 40 and 41, crosslink 39, drive bars 64 and 65, and gyro rotor 37 are all interconnected and rotate as a unit about transverse rotor axis 19, except for gyro rotor 37 which rotates about gyro axis 56. During operation, the thrust produced by rotating blades 23 and 24 in a direction parallel to axis 19 is varied by manual rotation of bell crank 29 about pivot connection 30 which translates push-pull rod and the interconnected components (collar 38, gyro rotor 37, gyro mount 36, slider 35, crosslink 39, and pitch links 40 and 41) along axis 19. The resulting, transverse movement of pitch links 40 and 41 pivots blades 23 and 24 about their pitch axis which varies the collective pitch and, correspondingly, the rotor thrust. This thrust force produces a yaw moment about the main rotor axis of the helicopter. Because gyro rotor 37 is displaced linearly by the motion of push-pull rod 31, gyro rotor 37 does not precess (tilt). That is, there is no rotation of gyro rotor 37 about any axis other than its axis of rotation 56 (which, in a zero or neutral condition, coincides with rotor axis 19).

Wind gusts or changes in the torque of the main rotor system during normal operation of the helicopter may cause the helicopter to suddenly yaw (rotate about the main rotor axis). In general, application of a moment to a gyroscopic mechanism in any plane other than the plane of rotation will cause it to precess. Yaw motion of the helicopter effectively applies a moment to gyro rotor 37 about an axis perpendicular to both axes 53 and 19, which causes it to precess about pivot axis 53, thereby displacing axle portion 49 between limits 56*a* and 56*b*. As long as bellcrank 29 is held fixed by the pilot, angular displacement of pivot arm 50 displaces pitch slider 35 via semi-flexible slider link 59 to vary the collective pitch of tail rotor 11 through cross bar 39 and pitch links 40 and 41. The resulting change in thrust opposes the motivating yaw motion.

The limits of yaw correction produced by yaw stabilizing assembly 10 are defined by angled faces 42 and 43. That is, as pivot arm 50 rotates about pivot axis 53, and gyro rotor 37 rotates about axle portion 49, the planar inboard side 72 of gyro rotor 37 will eventually meet either face 42 or 43. Once gyro rotor 37 precesses against this mechanical limit, no further precession is possible, and so no further gyroscopic input to the tail rotor assembly is possible.

Functionally, the current invention establishes a stabilizing offset or adjustment to the pilot's tail rotor controls. Continuous pilot yaw control inputs necessary to swing the helicopter to a new heading cause the gyroscopic assembly to precess to a preset limit after which point the mechanism no longer acts to counter the change in yaw. Instantaneous control inputs displace the gyroscopic assembly substantially parallel to its axis of rotation. Such linear displacement has no precessional effect on the gyroscopic assembly, and so the gyroscopic mechanism described herein does not impede such inputs. This means that the current invention stabilizes the helicopter, but does not unduly inhibit pilot control.

Alternative embodiments are contemplated wherein the gyro pivot axis 53 may be slanted somewhat relative to horizontal to achieve gyroscopic reaction to both yaw and roll.

Further embodiments are contemplated wherein springs 74 and 75 are replaced in function by a spring assembly connecting gyro mount 36 and pitch slider 35, a spring assembly connecting gyro mount 36 and gyro pivot arm 50, or a flexible hinge made from a material such as Nylon connecting axle portion 49 and gyro mount 36 at or near pivot axis 53.

Figure 4:
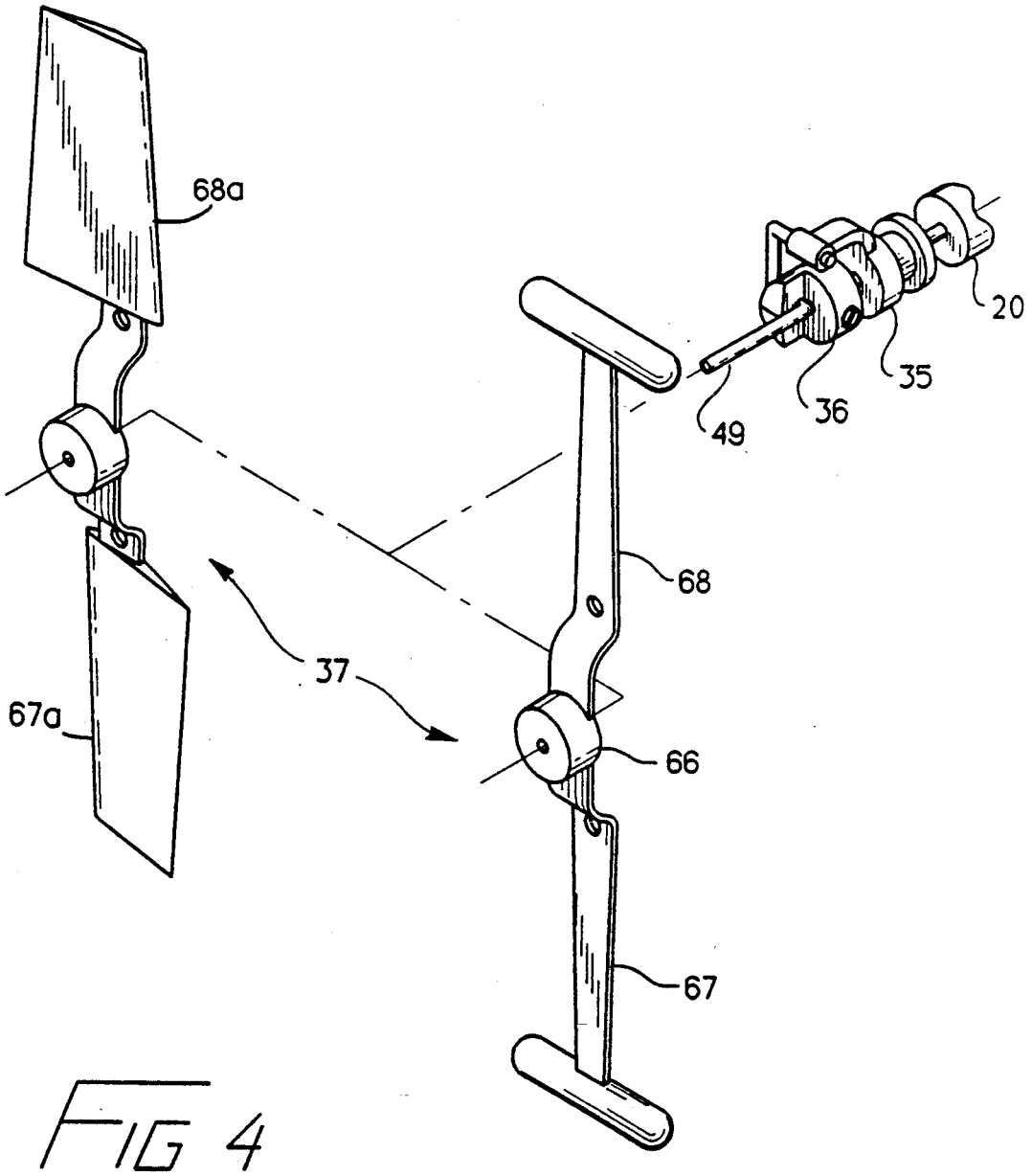
FIG. 4 is an additional embodiment of the gyro arms which are airfoiled in cross-section.

Additional embodiments are also contemplated wherein weighted arms 67*a* and 68*a* are airfoiled in cross-section so as to act as a secondary tail rotor system as shown in FIG. 4.

Other embodiments are also contemplated wherein the mechanical limits of the automatic gyroscopic stabilization may be provided by limiting the travel of pitch slider 35 or the displacement of pivot arm 50.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a helicopter having a tail rotor with a plurality of rotor blades extending radially from a hollow rotor shaft which is mounted for rotation about a transverse rotor axis, and having a push-pull rod extending through the hollow shaft and operably connected to the blades to manually vary the collective pitch of the blades, a device for automatically stabilizing the yaw motion of the helicopter, comprising:

a gyroscopic assembly including a gyro rotor mounted to rotate with the tail rotor, to pivot about a substantially longitudinal pivot axis at the outboard end of the push-pull rod and to automatically vary the collective pitch of the blades in response to yaw motion.

2. The device of claim 1 wherein the pivot axis orthogonally intersects the transverse rotor axis.

3. The device of claim 1 further including a pitch slider operably connected with the push-pull rod, tail rotor and gyro rotor to move generally as a unit with the push-pull rod in order to vary the collective pitch of the blades upon manual movement of the push-pull rod relative to the rotor shaft.

4. The device of claim 3 wherein the pitch slider is operably connected with the push-pull rod, tail rotor, and gyro rotor to be automatically slid relative to the push-pull rod to vary the collective pitch of the rotor blades upon precession of the gyro rotor.

5. The device of claim 4 further including a gyro mount fixed to the outboard end of the push-pull rod and supporting a gyro pivot arm to pivot about the pivot axis, said pivot arm having an axle portion which coexists with and defines a gyro axis and which extends from the intersection of the pivot and rotor axes to rotatably support the gyro rotor.

6. The device of claim 5 further including linkage means operably connecting the axle portion of the pivot arm with the pitch slider to move the slider relative to the push-pull rod when the axle portion pivots about the pivot axis.

7. The device of claim 1 further including drive means for driving the gyro rotor along with the tail rotor and centering means for biasing the gyro rotor to a neutral position.

8. The device of claim 7 wherein the drive means includes a cross link and drive bars mounted to rotate about the pitch slider, and the centering means includes spring means for biasing the gyro rotor to rotate about the rotor axis.

9. The device of claim 1 further including limiting means for limiting the degree to which the gyroscopic assembly can vary the collective pitch of the rotor blades.

10. The device of claim 9 wherein said limiting means includes a gyro mount fixed to the outboard end of the push-pull rod, said gyro mount defining a pair of pivot limit faces against which the gyro rotor abuts when pivoted to maximum pivot angles about the substantially longitudinal pivot axis.

11. The device of claim 1 wherein the gyro rotor includes a plurality of gyro arms extending radially from a gyro hub.

12. The device of claim 11 wherein the gyro rotor includes a pair of weighted arms that are airfoiled in cross section so as to produce a thrust force and operate as a secondary tail rotor.

13. A helicopter, comprising:

a main body with a power source;

a main rotor assembly supported for rotation about a substantially vertical axis by said main body and driven by said power source;

a tail boom extending rearward from said main body;

a tail rotor assembly having a tail rotor with a plurality of rotor blades extending radially from a hollow rotor shaft which is mounted to said tail boom for rotation about a transverse rotor axis, and having a push-pull rod extending through the hollow shaft and operably connected to the blades to manually vary the collective pitch of the blades; and yaw stabilizing means for automatically stabilizing the yaw motion of the helicopter including a gyro rotor mounted to rotate with the tail rotor, to pivot about a substantially longitudinal pivot axis at the outboard end of the push-pull rod and to automatically vary the collective pitch of the blades in response to yaw motion.

14. The helicopter of claim 13 wherein the pivot axis orthogonally intersects the transverse rotor axis.

15. The helicopter of claim 13 wherein said yaw stabilizing means further includes a pitch slider operably connected with the push-pull rod, tail rotor and gyro rotor to move generally as a unit with the push-pull rod to vary the collective pitch of the blades upon manual movement of the push-pull rod relative to the rotor shaft.

16. The helicopter of claim 15 wherein the pitch slider is operably connected with the push-pull rod, tail rotor and gyro rotor to be automatically slid relative to the push-pull rod to varying the collective pitch of the rotor blades upon precession of the gyro rotor.

17. The helicopter of claim 13 wherein said yaw stabilizing means further includes a gyro mount fixed to the outboard end of the push-pull rod and supporting a gyro pivot arm to pivot about the pivot axis, said pivot arm having an axle portion which coexists with and defines a gyro axis and which extends from the intersection of the pivot and rotor axes to rotatably support the gyro rotor.

18. The helicopter of claim 17 wherein said yaw stabilizing means further includes linkage means operably connecting the axle portion of the pivot arm with the pitch slider to move the slider relative to the push-pull rod when the axle portion pivots about the pivot axis.

19. The helicopter of claim 13 wherein said yaw stabilizing means further includes drive means for driving the gyro rotor along with the tail rotor and centering means for biasing the gyro rotor to a neutral position.

20. The helicopter of claim 19 wherein the drive means includes a cross link and drive bars mounted to rotate about the pitch slider, and the centering means includes spring means for biasing the gyro rotor to rotate about the rotor axis.

21. The helicopter of claim 13 further including limiting means for limiting the degree to which the gyroscopic assembly can vary the collective pitch of the rotor blades.

22. The helicopter of claim 21 wherein said limiting means includes a gyro mount fixed to the outboard end of the push-pull rod, said gyro mount defining a pair of pivot limit faces against which the gyro rotor abuts when pivoted to maximum pivot angles about the substantially longitudinal pivot axis.

23. The helicopter of claim 13 wherein the gyro rotor includes a plurality of gyro arms extending radially from a gyro hub.

24. The helicopter of claim 23 wherein the gyro rotor includes a pair of weighted arms that are airfoiled in cross section so as to produce a thrust force and operate as a secondary tail rotor.

25. A device for stabilizing the yaw motion of a helicopter having a main rotor, a power source for driving a tail rotor, and a tail boom with a longitudinal axis, comprising:

a tail rotor mountable to one side of the tail boom and rotatable about a transverse rotor axis by the power source to generate a thrust force transverse to the tail boom and rearward of the main rotor axis;

thrust varying means for permitting a pilot to remotely vary the magnitude of the thrust force; and gyroscopic means operably mounted with said tail rotor outward and to one side of both said tail rotor and tail boom for automatically varying the thrust force of said tail rotor to oppose yaw motion.

26. The device of claim 25 wherein said tail rotor includes rotor blades extending radially from a rotor shaft, wherein said thrust varying means includes linkage operably connected with the rotor blades to permit manual variation of the collective pitch of the rotor blades, and wherein said gyroscopic means includes a gyro rotor mounted to pivot about a longitudinal pivot axis outward of said tail rotor.

27. The device of claim 26 wherein the pivot axis orthogonally intersects the transverse rotor axis.

28. The device of claim 27 wherein the rotor shaft is hollow, the linkages include a push-pull rod extending through the hollow shaft, and the gyro rotor is mounted at the outboard end of the push-pull rod for rotation with the tail rotor.

29. The device of claim 28 wherein said thrust varying means includes a pitch slider operably connected with the Push-pull rod, tail rotor and gyro rotor to move generally as a unit with the push-pull rod to vary the collective pitch of the blades upon manual movement of the push-pull rod relative to the rotor shaft.

30. The device of claim 29 wherein the pitch slider is operably connected with the push-pull rod, tail rotor and gyro rotor to automatically slide relative to the push-pull rod to vary the collective pitch of the rotor blades upon precession of the gyro rotor.

31. The device of claim 30 further including a gyro mount fixed to the outboard end of the push-pull rod and supporting a gyro pivot arm to pivot about the pivot axis, said pivot arm having an axle portion which coexists with and defines a gyro axis and which extends from the intersection of the pivot and rotor axes to rotatably support the gyro rotor.

32. The device of claim 31 further including linkage means operably connecting the axle portion of the pivot arm with the pitch slider to move the slider relative to the push-pull rod when the axle portion pivots about the pivot axis.

33. The device of claim 31 further including drive means for driving the gyro rotor along with the tail rotor and centering means for biasing the gyro rotor to a neutral position.

34. The device of claim 33 wherein the drive means includes a cross link and drive bars mounted to rotate about the pitch slider, and the centering means includes spring means for biasing the gyro rotor to rotate about the rotor axis.

35. The device of claim 26 further including limiting means for limiting the degree to which the gyroscopic assembly can vary the collective pitch of the rotor blades.

36. The device of claim 26 wherein the gyro rotor includes a pair of weighted arms that are airfoiled in cross section so as to produce a thrust force and operate as a secondary tail rotor.

37. A device for stabilizing the yaw motion of a helicopter having a main rotor, a power source for driving a tail rotor, and a tail boom with a longitudinal axis, the device comprising a tail rotor mountable to the tail boom of a helicopter to be rotated about a transverse rotor axis by the power source to generate a thrust force transverse to the tail boom and offset from the main rotor axis, thrust varying means for permitting a pilot to remotely vary the magnitude of the thrust force, gyroscopic means for automatically varying the thrust force to oppose yaw motions, and means for independently connecting each of the gyroscopic means and the thrust varying means to the tail rotor so that each of the thrust varying means and the gyroscopic means operates independently to vary the thrust force generated by the tail rotor.

38. A device for stabilizing the yaw motion of a helicopter having a main rotor with a main axis, a power source for driving a tail rotor, and a tail boom with a longitudinal axis, the device comprising a tail rotor supported for rotation about a transverse rotor axis, the tail rotor including a hollow rotor shaft operably connectable to be driven by the power source and including a plurality of rotor blades extending radially from said rotor shaft along respective pitch axes, the collective pitch of the rotor blades being variable, pitch varying means extending through the shaft for permitting the pilot of the helicopter to manually vary the magnitude of the collective pitch, the pitch varying means including a push-pull rod coupled to the rotor blades, and gyroscopic means for automatically varying the collective pitch of the rotor blades in response and opposition to yaw motions, the gyroscopic means including a gyro rotor and means for pivotably mounting the gyro rotor to the push-pull rod so that the gyro rotor pivots relative to the push-pull rod to vary the collective pitch of the rotor blades to supplement any pitch variance caused by concurrent operation of the pitch varying means.

39. A device for automatically stabilizing the yaw motion of a helicopter having a tail boom, a tail rotor including rotor blades, and pitch varying means for varying the pitch of the rotor blades, the device comprising pilot means for providing a primary input to the pitch varying means to vary the pitch of the rotor blades and thereby change the magnitude of thrust force generated by the tail rotor, the pilot means including a primary linkage connected to the pitch varying means and means for moving the primary linkage to actuate the pitch varying means, and gyroscopic means for providing a supplemental input to the pitch varying means to adjust continuously the pitch of the rotor blades established by the pilot means to counter any intermittent changes in yaw caused by external forces applied to the helicopter during flight without varying the primary input provided by the pilot means, the gyroscopic means including a gyro rotor, means for mounting the gyro rotor for pivotable movement relative to the tail rotor in response to application of external forces to the helicopter in flight, and a secondary linkage interconnecting the pivotable gyro rotor and the pitch varying means and moving independently of the primary linkage to adjust the pitch of the rotor blades established by the pilot means.

40. The device of claim 39, wherein the primary linkage includes a reciprocable push-pull rod and the mounting means is appended to the push-pull rod.

41. The device of claim 40, wherein the tail rotor further includes a hollow rotor shaft mounted for rotation about a transverse rotor axis, the push-pull rod extends through the hollow rotor shaft and includes an inner end positioned to lie adjacent to the tail boom of the helicopter and an outer end positioned to lie away from the tail boom of the helicopter, and the mounting means is appended to the outer end of the push-pull rod to position the hollow rotor shaft between the gyro rotor and the tail boom.

42. The device of claim 40, wherein the primary linkage includes a bell crank coupled to the moving means, the push-pull rod is coupled to the bell crank and the pitch varying means, and the secondary linkage is situated to lie in spaced-apart relation to the push-pull rod and is movable relative to the push-pull rod.

43. The device of claim 40, wherein the secondary linkage includes means for sliding back and forth on the push-pull rod.

44. A device sensitive to angular displacement, the device comprising a plurality of blades extending from a rotatable hollow shaft, a push-pull rod extending through the hollow shaft and operably connected to the blades to collectively control the pitch of the blades, and a gyroscopic assembly including a gyro rotor mounted to rotate with the hollow shaft, to pivot about a pivot axis located at or near the end of the push-pull rod, and to automatically vary the collective pitch of the blades in response to angular displacement of the device.

45. The device of claim 44, further comprising drive means for driving the gyro rotor along with the hollow shaft and centering means for biasing the gyro rotor to a neutral position.

46. In a helicopter having a tail rotor with a plurality of rotor blades extending radially from a hollow rotor shaft which is mounted for rotation about a transverse rotor axis, and having a rod extending through the hollow shaft and operably connected to the blades to manually vary the collective pitch of the blades, a device for automatically stabilizing the yaw motion of the helicopter comprising a gyroscopic assembly including a gyro rotor mounted to rotate with the tail rotor, to pivot about a substantially longitudinal pivot axis at the outboard end of the rod and to automatically vary the collective pitch of the blades in response to yaw motion.

* * * * *